United States Patent [19]

Palmer et al.

[11] 4,355,063

[45] Oct. 19, 1982

[54] CHEMICALLY EMBOSSED CARPET AND THE METHOD OF CARRYING OUT CHEMICAL EMBOSSING WHILE PRESERVING TEXTURE

[75] Inventors: Leon B. Palmer, Little Falls; Robert P. Conger, Park Ridge, both of N.J.

[73] Assignee: Congoleum Corporation, Kearny, N.J.

[21] Appl. No.: 178,572

[22] Filed: Aug. 15, 1980

Related U.S. Application Data

[63] Continuation of Ser. No. 760,845, Jan. 21, 1977, abandoned, which is a continuation of Ser. No. 666,692, Mar. 15, 1976, abandoned, which is a continuation of Ser. No. 429,949, Jan. 2, 1974, abandoned.

[51] Int. Cl.[3] ..... B32B 33/00

[52] U.S. Cl. ..... 428/89; 8/130.1; 428/96

[58] Field of Search ..... 428/88, 89, 96; 8/130.1; 28/72 P, 72.17, 74 P; 26/2 R, 18.5, 69 A, 69 B; 156/277

[56] References Cited

U.S. PATENT DOCUMENTS 2,020,698 11/1935 Platt ..... 428/89

3,856,598 12/1974 Gregorian ..... 428/89

*Primary Examiner*—Marion McCamish

*Attorney, Agent, or Firm*—Richard T. Laughlin; Daniel J. Reardon; Walter Katz

[57] ABSTRACT

Pile fabrics, which have been prepared from nylon carpet fibers having a textured or embossed surface induced by a chemical shrinking process for developing the texture of the fabric, involving selectively contacting the surface of certain areas of the carpet with a chemical fiber shrinking agent for the nylon fibers and allowing the shrinking action to occur, and, thereafter, removing the shrinking agent from the fibers, the thus treated areas, thereafter, showing a reduced height of pile to create the texture of the fabric, are kept soft in the treated areas by simultaneously incorporating in the shrinking material, or of the dye composition used as a combination color and shrinking material, a protective agent compatible with the fiber and also one which is not destroyed by the chemical nature of the shrinking or dyeing compositon to maintain the shrunk fibers soft and pliant.

9 Claims, 2 Drawing Figures

CHEMICALLY EMBOSSED CARPET AND THE METHOD OF CARRYING OUT CHEMICAL EMBOSSING WHILE PRESERVING TEXTURE

This application is a continuation of copending application Ser. No. 760,845 filed Jan. 21, 1977, (now abandoned) which is a continuation of application Ser. No. 666,692 filed Mar. 15, 1976 (now abandoned), and which is, in turn, a continuation of application Ser. No. 429,949 filed Jan. 2, 1974, (now abandoned).

BACKGROUND OF THE INVENTION

In the production of nylon pile fabrics, it is often desirable to emboss the surface thereof in order to provide added decorative appeal. In some instances, the embossed areas are printed with dyes to embellish the surface design further.

Embossing of pile fabrics is conventionally accomplished with a heating embossing roll or plate which has been engraved or otherwise treated to create the design desired in raised relief on the surface. A method which eliminates the use of embossing rolls has been disclosed in U.S. Pat. Nos. 2,790,255 and 2,875,504. In accordance with these patents, the pile fabric is formed from a combination of shrinkable and non-shrinkable yarns. Upon subjecting the fabric to the influence of heat, the pile formed from the shrinkable yarns contracts while the base and nonshrinkable yarns remain intact thereby yielding a pile made up of high and low areas to give the appearance of an embossed or carved product.

A chemical embossing method is disclosed in U.S. Pat. No. 2,020,698. According to this patent, fabric having a pile of organic ester of cellulose yarn is locally treated with an alkali or alkaline salt saponifying agent in order to obtain ornamental differential effects in the treated areas. Furthermore, since the organic ester of cellulose pile yarns that have not been saponified are more difficult to change from their position, after they are once set than are the saponified organic ester of cellulose yarns, it is possible to obtain a differential lay between the saponified and unsaponified organic ester of cellulose pile yarn. Thus, the fabric, after the application of the saponifying agent, may be washed, finished and dried with the pile erect, after which the fabric may be run through water and brushed across the piece to lay the pile toward the selvage and it is then dried. This causes the saponified pile yarn to lie flat while the unsaponified yarn remains substantially erect. Upon subsequent steaming and brushing the fabric in the opposite direction, any unsaponified yarn which may have been slightly bent from the vertical by the previous brushing toward the selvage is caused to stand erect without disturbing the position of the laid or crushed saponified organic ester of cellulose pile yarn.

SUMMARY OF THE INVENTION

It is the primary object of this invention to provide a simple process for producing a nylon pile having a textured or embossed surface.

Another object is to provide such a process which is readily adaptable to standard printing equipment.

Another object is to provide a process which allows the production of pile fabric having embossed areas in register with a printed design.

A further object is to provide an embossing process which is readily adaptable to curved and irregular surfaces.

Various other objects and advantages of this invention will be apparent from the following detailed description thereof.

We have discovered that it is possible to produce superior nylon fabrics having embossed surfaces by contacting selected portions of the surfaces with a chemical shrinking agent compounded with a protective material for the fibers of the said pile fabric, causing dimensional change by linear contraction, and simultaneously protecting against hardening, stiffening or harshening and, thereafter, effectively removing the embossing agent. The resulting product is thus depressed at the treated areas and the treated areas are of a texture matching that of untreated areas.

The embossing composition can be transparent so that the appearance of the product is not altered other than in being embossed. Alternatively, the embossing agent can be part of a dye or pigment composition used in printing the fabric so that the color appears in perfect register in the areas of embossing agent application.

The depth of the depressed areas can be controlled by varying the concentration and/or type of embossing agent. This variation in concentration can be effected by the amount of vehicle applied as well as by the strength of the embossing agent.

Furthermore the embossed depth can be controlled to some degree by the depth of penetration of the print paste carrying the embossing agent as well as the steamer time and steamer temperatures to which the pile fabric is subjected in order to activate the chemical embossing agent which provides the desired effect.

This discovery makes possible the production of a product having embossed surfaces which can be in complete register with a printed design. Additionally, the discovery makes possible the utilization of many types of printing apparatus for purposes of effecting embossing, thereby eliminating the need for expensive embossing equipment. Further, it allows the embossing of a surface without exerting sufficient pressure to permanently deform the pile fabric. A great number of products can be produced by the process. They can be used for floors, wall and ceiling coverings, drapery, upholstery and the like, and, in fact, wherever pile fabrics are utilized. They are readily adaptable to decorating any surface on which pile fabrics can be applied. Many additional applications will occur to those skilled in the art.

This invention will be better understood from the following detailed description thereof together with the accompanying self-explanatory drawings in which:

FIG. 1 is an enlarged top view of a section of an embossed product of this invention and FIG. 2 is an enlarged cross-sectional view of the same product taken through line 2—2.

DESCRIPTION OF PREFERRED EMBODIMENT

Deeply embossed areas of nylon carpet, which have been produced by selectively contacting the surface of the nylon carpet with a chemical fiber shrinking agent therefor are often characterized by an undesirable degree of hardness, stiffness and harshness. This can usually be avoided by a lessening of the depth of embossment e.g. reducing the extent to which the fibers are shrunk or by decreasing the concentration of chemical shrinking agent in the print paste. However, when a maximum depth of embossment is desired, as is usually the case, it has been discovered that the development of harsh nylon pile can be greatly reduced by adding a small amount of certain chemical products, directly to the embossing print without interfering with either the embossing or the dying.

Figure 1:
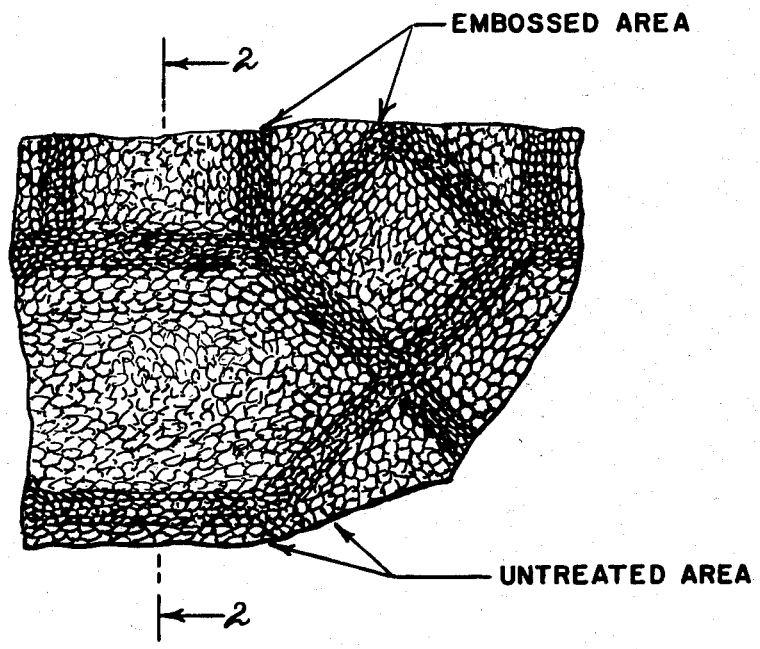
Figure 2:
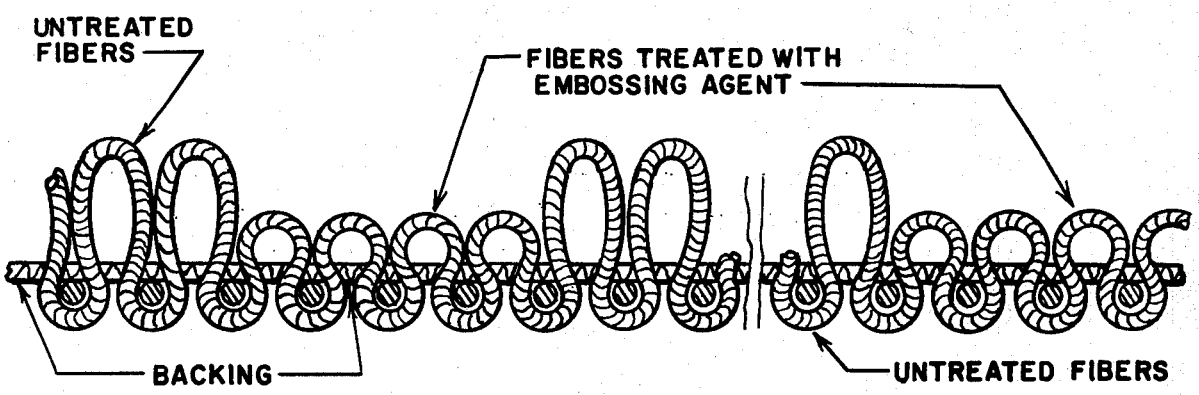

The term "embossing agent" is defined as any active chemical composition which when applied to the carpet pile produces a measurable reduction of the pile height, but without significant deterioration of the shrunk fibers as shown in FIGS. 1 and 2. One of the purposes of this invention is to extend the utility of the embossing agent so that greater depths of embossment or fiber shrinkage can be obtained unaccompanied by the undesirable degree of fiber hardness and harshness usually experienced when embossing is of maximum depth. This is not to say that embossed areas having harsh pile are not perfectly serviceable. It is to say, however, that such harshness may be considered undesirable by the consumer.

For purposes of this invention, the term "protector" or "protective agent" is defined as any chemical composition which when applied to the carpet pile in conjunction with a shrinking agent serves to protect or shield the carpet fibers against the development of hardness, stiffness or harshness during the chemical shrinking process.

Typical examples of embossing agents capable of producing deep embossed effects which can benefit by the incorporation of a fiber protective agent in the embossing print paste have been disclosed in prior pending patent applications and include the following agents: Monochloroacetic Acid; Resorcinol; Benzotriazole/Acetic Acid; Zinc Chloride/Acetic Acid; Dimethylthiourea/Formic Acid. Details of these processes are given in copending applications—Ser. No. 386,048, Ser. No. 386,037 and Ser. No. 386,047, all filed Aug. 6, 1973.

The protective agents which are useful in this invention are usually substances of an aliphatic nature of considerable molecular length. Many of these agents are derived from straight chain fatty radicals containing 12–18 carbon atoms and preferably 16–18 carbon atoms or more. They are mostly water insoluble materials and are usually supplied as proprietary products for use as opaque pastes, dispersions or emulsions. Preferably they are substantive to the carpet pile fibers, although certain nonionic and anionic materials which are not substantive may be quite effective. Protective agents mainly become located on the surface of the fibers i.e. coat the fibers comprising the carpet pile. Materials that penetrate and plasticize the fibers are usually less effective to counteract any harshness that develops in the shrunk fibers.

Cationic substantive agents generally afford the most protection because they become strongly attached to the nylon fibers. This is because the positively charged molecules of the agent are attracted by the negatively charged fibers. This permits the hydrophobic portion of the molecule i.e. the fatty, waxy, oily portion, to be exposed, imparting pliability, lubricity, and softness to the fibers as well as curability against being removed by water. Several types of cationic agents are often particularly effective. These include long chain quarternary ammoniums compounds, fatty acid amides and amines, and derivatives of imidazoline. Effective nonionic types include silicone and polyethylene.

The mode of action of the protector or protective agent as utilized in the subject invention to suppress the development of harshness, hardness and stiffness of chemically embossed fibers is not fully understood. However, it is believed that the protective agent functions primarily by coating the surface of the fibers comprising the carpet pile and thus preventing the agglutination and fusion of fibers as well as reducing the friction between fibers and filaments. Thus, a soft feel is preserved in the otherwise harsh shrunken fibers.

The proprietary nature of most suitable protective agents commercially available, and the reluctance of manufactureres to divulge their chemical constitution, makes it almost impossible to chemically describe and categorize exactly by formula the agents which are useful in this invention. Generally, however, suitable protective agents will be found in one or more of the following main classes—cationic, anionic, nonionic, amphoteric. It should be understood that agents suitable in this invention are often complex mixtures sold as proprietary compositions rather than single compounds. Blends or combinations sometimes comprise materials from two or three different classes.

Thus, the invention in the instant case is concerned with significantly extending the range of usefulness of chemical shrinking agents for fibers and carpet or, in other words, chemically embossed carpet, so that the shrunk pile will have a texture or hand closely approximating that of the unshrunk pile, it being the purpose to formulate shrinking compositions and shrinking dyeing compositions with protective agents of any kind in amount and in concentration such that this effect is achieved. Briefly, we have found that whether the chemical shrinking composition, be an acid, a phenol, a combination of metal halide and an acid or a combination of nitrogenous compound and an organic acid, as outlined in our copending applications, it is possible to incorporate into the shrinking composition a fiber protective agent in amounts ranging from about ¼ percent to about 5 percent of the total composition, thereby to make available in the treated embossed or shrunken area a protective agent, which will make possible the shrinkage of the fibers to an acceptable extent significantly beyond that which is attainable without use of the agent.

Other objects and advantages of the invention will in part be obvious and in part appear hereinafter.

Typical examples of protective agents which are members of the above classes are indicated in the following:

CATIONIC AGENTS

This class of agents generally includes fatty amine types, fatty amide types, quarternary ammonium compounds, imidazoline types and ethoxylated amine types.

Some typical members of this class are described by their manufacturers as follows:

- Fatty Acid Condensate
- Fatty Acid Amide e.g. N,N'-distearyl-N'-ethanol ethylene diamine
- Complex fatty amide condensate
- Fatty amido amine
- Fatty acid-amine salts (acetatehydrochloride)
- Fatty amino condensate
- Fatty carbamides
- Stearocarbamide complex
- Fatty acid imidazoline condensate
- 2-Heptadecyl-1-1methyl-1-(stearoyl amido ethyl) imidazoline methosulphate
- Imidazoline derivative
- Alkylimidazoline
- Complex alkyl amido imidazolium sulfate
- Acetate salt of heptodecyl imidazoline

QUARTERNARY AMMONIUM AGENTS

Long chain substituted quarternary ammonium compounds are also cationic in nature. The following are typical examples as described by the vendor.

Polyamido quarternary
Dimethyl distearyl quarternary
Dimethyl dihydrogenated tallow ammonium chloride
Stearyl dimethyl benzyl ammonium chloride

AMPHOTERIC AGENTS

Compounds representing this class function as cationic types (positively charged) under acid conditions and as anionic types (negatively charged) under alkaline conditions i.e.—they combine a positive and negative charge in one molecule. The anionic functional groups are often sulfonte, sulfate or carboxylate, and the compound may possess a quarternary ammonium group as well as a long fatty acid chain.

Vendors describe some of these products as follows:
Fatty acid derivatives
Modified fatty amide
Complex fatty amido compound
Stearocarbamide complex
Stearic acid derivative of cyclic imidazolinium
Complex dicarboxylate stearic acid derivative

NONIONIC AGENTS

Compounds in this class have a neutral charge. They are deposited mechanically on the fibers. This class of agents generally includes such types as polyethylene, silicone and polyoxyethylene derivatives, as well as fatty esters, fatty amides and other types. The following are typical exampes as described by the vendor.

Polyethylene (High and low density) (Can be also cationic and anionic depending upon the emulsifying agent.)
Fatty acid esters (modified, derivatives)
Glycol stearate ester
Fatty amide
Amino fatty acid condensate
Polyglycol fatty ester composition
Polyethylene glycol esters
Ethylene Oxide condensate
Polyethylene modified polyoxyethylene derivative
Silicone (oils, silicic, esters)
Polydimethyl siloxanes
Poly (methyl hydrogen) siloxane

ANIONIC AGENTS

Compounds in this class are generally the least satisfactory. They are negatively charged and generally not substantive to nylon (there are exceptions) and thus are mechanically deposited on the fibers. This class of compounds will generally include emulsions of oils, fats, and waxes, sulphated and sulphonated oils and tallows and sulphated fatty alcohols. The following are examples as described by the manufacturer:

Fatty acid derivatives
Fatty ester derivatives
Fatty carbamide salts
Sulfonated tallow
Amine type, substantive

BLENDS

Many protective agents are not only complex in nature, but may also consist of blends or combinations of chemical constituents representing more than one class of compounds. The following are: typical combinations offered by the manufacturer.

Polyethylene/fatty acid condensation product
Complex fatty amines/polyglycol condensation product
Ethylene oxide adduct/silicones
Fatty ester/quarternary ammonium compound
Amide condensate/polyethylene blend The following reference sources idenfity useful protective agents chemically and are to be considered fully incorporated herein:

1. Products/72, October 1971/Vol. 3, No. 10A Journal of the American Association of Textile Chemists and Colorists. Section 4, Directory of Textile Chemical Specialties; p. 218, item 56, Softeners
2. Softening Agents in Textile Processing; R. K. Narkar; Colourage, June 29, 1972 pp. 31–35, 40
3. Cationic Fabric Softeners; W. P. Evans; Chemistry and Industry, July 5, 1969; pp. 893–903
4. Fabric Softeners and Their Evaluation; L. Chalmers; Manufacturing Chemist and Aerosol News; September 1970 pp. 39–45
5. Evaluation of Additives Used in Resin Finishing of Cotton Fabrics; W. J. Roff; Textile Institute and Industry; October 1965 pp. 254–258
6. Evaluation of Cationic Softeners Shenai, V. A.; Mulla, A. H.; International Dyer and Textile Printer; Aug. 4, 1972 pp. 151–154
7. Cationic Softeners—Their Secondary Effects on Textile Fabrics; Philadelphia Section; American Association of Textile Chemists and Colorists; American Dyestuff Reporter; Jan. 28, 1957, pp. 41–57, 64
8. The Synthesis and Surface Active Properties of Certain Amphoteric Compounds; Linfield W. M., Abend P. G., Davis G. A.; Journal of the American Oil Chemists Society; March, 1963 pp. 114–117

Because of the large number of potential agents, and the proprietary nature of these agents, it is generally not possible to specify in advance how well an agent will perform in the embossing print pastes of the subject invention. Even similar commercial products are often sufficiently varied in constitution and properties to make a selection difficult, since they differ with regard to solubility, concentration, compatibility, and behavior. Therefore, it is necessary to determine suitability by trial and error in combination with the embossing agent and the carpet construction which is to be employed. Even when a protective agent is found to function in a desirable manner with one embossing system, it cannot be certain that similarly good results will be obtained if the chemical embossing agent and/or the carpet construction is changed. The extent of the protection may depend very much on the carpet construction. Also the most effective concentration of agent to be used must be determined by trial and error. The most suitable concentration of agent to be used will depend upon a number of things, including such factors as active solids content of the agent (often unknown), carpet construction, print paste pick-up by carpet pile, process conditions, and type of chemical embossing agent. Generally, however, a suitable concentration will be found within the range ¼ to 5% protective agent by weight of the total embossing print paste.

In order to practically evaluate the usefulness of a selected protective agent in an embossing system for nylon carpet, the agent is added directly to the embossing print paste (with or without dye) and applied to the section of the nylon carpet by means of a screen printing technique so as to simulate plant production procedure as closely as possible. The treated carpet is steamed for 15 minutes at 215°-220° F., thoroughly rinsed with water and dried. The embossed areas are then rubbed to loosen the embossed pile. Another section of nylon carpet is similarly treated, but without protective agent added to the embossing print paste. The carpet areas which have been embossed with and without protective agent are then compared with adjacent unembossed carpet pile for depth of embossement, retention of softness, color and resistance to soiling.

In preparing the embossing print paste recipe containing the protective agent, it is generally preferred to add the agent after the embossing agent has been incorporated in the system. In some cases, the embossing agent e.g. monochloroacetic acid, exerts a strong cooling effect on the print paste recipe as it dissolves. Preferably the protector will not be added until at least room temperature is regained, and sometimes warming may be necessary in accordance with vendors' instructions for incorporating a particular compound.

Besides providing the desired protection of the shrunk nylon fibers, the protective agent must meet a number of other requirements, as follows, to be suitable for the purposes of this invention.

a. It must be readily dispersible in, compatible with and remain stable in the chemical embossing print paste at room conditions. All particles of protective agent must be fine enough to pass through the printing screens.
b. It must not interfere with the shrinking action of the chemical embossing agent contained in the print paste.
c. It must not cause deterioration of the embossed carpet finished qualities.
d. It must not interfere with print paste dyeing so that final color is deteriorated, or lessen the lightfastness of the dyed carpet.
e. It must not contribute to soiling to an extent that the resistance to soiling and soil retention of the embossed pile is worse than that of the unembossed carpet pile. The following test methods are employed to determine whether or not the protective agent being evaluated meets the aforementioned requirements.

a. Compatibility with the Embossing Print Paste—Determined visually be inspecting for any separation or precipitation which may occur during a 16 hour ageing period at room conditions. There must not be any separation which cannot be easily and uniformly dispersed by mild agitation.
b. Fineness of Dispersion in Print Paste—During printing, there must be no particles of print paste remaining on the printing screen.
c. Depth of Embossment—The pile height is measured at adjacent embossed and unembossed locations by means of a thin steel ruler marked off in 1/64 inch (0.4 millimeter) intervals and the percentage embossment calculated therefrom. Any method of measurement is appropriate so long as it is standardized from operation to operation and is reproducible to about 1/64 inch i.e. the depth of embossment measurement should be reproducible to ± about 3%.
d. Harshness of Shrunk Fibers—The harness of the embossed carpet pile without protective agent is compared with that of similar embossed areas treated with protective agent and with the unembossed carpet pile by feeling with the finger tips. Reductions in harshness are quite apparent using this test method.
e. Carpet Deterioration—Compare the carpet pile and carpet backing at embossed and unembossed areas. There must be no evidence of deterioration due to the protective agent.
f. Dye Color Stability—The color of the embossed carpet pile treated with the protective agent must not change to an uncontrollable degree compared to the embossed carpet pile which has not been treated with the agent. The agent should not reduce the lightfastness of the dyed carpet significantly when tested in the conventional manner.
g. Soil Resistance—Sections of nylon carpet, unembossed and embossed, treated with softening agent (both undyed) are installed in a foot traffic area and vacuum cleaned and rotated every 2½ days for a total period of 20 days. Resistance to soiling and soil retention of the embossed areas treated with softener must be no worse than that of the unembossed areas.

The following examples will further illustrate the embodiment of this invention. In these examples, all parts given are by weight unless otherwise noted.

EXAMPLE I

This examples illustrates the preparation of the improved chemically embossed pile fabric typical of the product of this invention utilizing a commercial protective compound to relieve the undesirable harshness of the shrunk nylon pile which develops when nylon carpet is deeply embossed by chemical means.

A series of rectangular areas of nylon carpet measuring 6 inches by 2 inches, 1 inch, ½ inch, ¼ inch and ⅛ inch respectively were treated simultaneously by means of a screen printing technique with a dye print paste containing 48½% monochloracetic acid as the chemical embossing agent and 1% Pomosoft EAM as the protective agent. Pomosoft EAM is an aqueous dispersion of a 25% active cationic compound supplied by Piedmont Chemical Industries. At the same time, another section of carpet was treated in a similar manner with the exception that the protective agent was omitted from the embossing print paste. This sample was designated as the control (Sample No. 488SP-1).

The following carpet construction was used:

Type—100% nylon 6/6, spun yarn, non heat set
Face Weight—28 oz/yd. sq. (950 grams/sq. meter)
Machine Gauge—5/32 inch (3.96 millimeters)
Machine Stitch Rate—9.6 stitches/inch (3.8 stitches/centimeter)
Pile Height—17/32 inch, singles (1.35 centimenters)

The embossing dye paste containing the protective agent was formulated as follows:

| SAMPLE NO. 490SP-1 | |
|---|---|
| Material* | Grams |
| 1. Water | 30.7 |
| 2. Cibaphasol AS | 0.5 |
| 3. Antifoam #73 | 0.8 |
| 4. Polygum 260 (5%) | 19.0 |
| 5. Monochloroacetic Acid | 49.0 |
| 6. Dye | 0.05 |

-continued

| SAMPLE NO. 490SP-1 | |
|---|---|
| Material* | Grams |
| 7. Pomosoft EAM | 1.0 |

*2-Sulfuric acid ester, levelling and penetrating agent
3-Alcohol ether, antifoaming agent
4-Locust bean gum thickening agent producing a Brookfield Viscosity of 640 cps. at 78° F. (#3 spindle, 2½ rpm)
7-An aqueous dispersion of a 25% active cationic protective agent supplied by Piedmont Chemical Industries, High Point, North Carolina. This material is dispersible, compatible, and stable in the strongly acidic print paste system.

There was no evidence of embossing while the printed nylon carpet remained at room temperature for several minutes. Upon subjecting the carpet to steaming for 15 minutes at about 216° F., deep embossing was observed due to fiber shrinkage. Thereafter, the carpet was throughly rinsed with water, dried and rubbed. The rinsing removed the residual embossing chemicals.

Both of the resulting capets with and without protective agent exhibited deep embossing with a 53% reduction in pile height in the treated areas in perfect register with the printed rectangles. However, the shrunk pile in the embossed area obtained utilizing the printing paste containing no protector (control sample) was considered to be undesirably hard and harsh, although the nylon tufts retained their individuality and were not otherwise deteriorated. By comparison, the shrunk pile in the embossed area obtained by means of the embossing print paste containing the compound Pomosoft EAM showed a substantial reduction in harshness thus providing an acceptably soft embossed area. Color at embossed areas was not affected by the protective agent. Foot traffic tests performed on additionally prepared undyed embossed sections of nylon carpet with and without the protective agent demonstrated that embossed areas both with and without protectors had better resistance to soiling and soil retention than unembossed areas (Sample nos. 654SP-1, 657SP-1, and 651SP-1).

EXAMPLE II

Nylon carpet was again treated as in Example I by means of a screen printing technique with a dye print paste containing 43½% monochloacetic acid as the chemical embossing agent and 1% Pomolube PE as the protective agent. Pomolube PE is an emulsion of polyethylene supplied by Piedmont Chemical Industries. At the same time a standard or control sample (#526SP-2) was prepared similarly except that the protective agent was omitted from the embossing print paste.

Carpet construction was as follows and differed from the carpet construction utilized in Example I with respect to heat setting, face weight, machine stitch rate and twist.

Type—100% Nylon 6/6, spun yarn, heat set
Face Weight—40 oz./sq. yd. (1356 grams/sq. meter)
Machine Gauage—5/32 inch (3.96 millimeters)
Machine Stitch Rate—7 stitches/inch (2.76 stitches/-centimeter)
Pile Height—17/32 inch, double twist (1.35 centimeters)

The embossing dye print paste recipe containing the protective compound was formulated as follows:

| SAMPLE NO. 527SP-2 | |
|---|---|
| Material* | Grams |
| 1. Water | 29.7 |

-continued

| SAMPLE NO. 527SP-2 | |
|---|---|
| Material* | Grams |
| 2. Cibaphasol AS | 0.5 |
| 3. Antifoam #73 | 0.8 |
| 4. Polygum 260 (5%) | 20.0 |
| 5. Monochloroacetic Acid | 49.0 |
| 6. Dye | 0.05 |
| 7. Pomolube PE | 1.0 |

*4-Brookfield viscosity 960 cps. at 78° F. (#3 spindle, 2½ rpm)
7-Polyethylene emulsion manufactured by Piedmont Chemical Industries, High Point, North Carolina - dispersible, compatible, stable with the strongly acidic embossing print paste.

Again, there was no evidence of embossing while the printed nylon carpet was held at room conditions for several minutes. Upon subjecting the carpet to steaming for 15 minutes at about 217° F., deep embossing occured both with and without the Pomolube PE due to shrinkage of the nylon carpet pile. Thereafter, the carpet was rinsed, dried, and rubbed.

Both of the resulting carpet samples, with and without the protective agent, exhibited deep embossing amounting to a 50% reduction in carpet pile height in the treated areas. Once again, however, the shrunk nylon tufts in the embossed area of the control nylon carpet containing no protective agent in the embossing print paste were considered to be undesirably harsh to the touch. By comparison, the shrunk tufts in the embossed areas of the carpet treated with the Pomolube PE were found to be acceptably soft and strong. The agent had no affect on carpet coloration. Foot traffic soiling tests were conducted on additionally embossed larger sections of nylon carpet construction Example I, without dye, and with and without protective agent in the printing paste. Compared to unembossed carpet, both embossed sections with the without protective agent were equally resistant to soiling; and greatly superior to the unembossed carpet for resistance to soiling and soil retention. (Samples Nos. 654SP-1, 656SP-1, 651SP-1).

EXAMPLE III

This example further illustrates the preparation of a soft chemically embossed nylon carpet pile typical of the products of this invention.

The nylon carpet construction cited in Example II was again treated by means of a screen printing technique. In this case, Pomolube PE (a polyethylene emulsion) was once again employed as the protective agent, but this time 23% Resorcinol was used as the chemical embossing agent. At the same time, a control sample (#696SP-1) was prepared in the same manner but with no protective agent. The embossing print paste recipe was as follows:

| SAMPLE NO. 695SP-1 | |
|---|---|
| Material* | Grams |
| 1. Water | 52.7 |
| 2. Cibaphasol AS | 0.5 |
| 3. Antifoam #73 | 0.8 |
| 4. Polygum #260 (5%) | 21.5 |
| 5. Resorcinol | 23.0 |
| 6. Dye | 0.05 |
| 7. Pomolube PE | 1.5 |

*4-Brookfield viscosity of 1120 cps. at 78° F. (#3 spindle, 2½ rpm)
7-Polyethylene emulsion, produced by Piedmont Chemical Industries. Dispersible, compatible, stable with the resorcinol system.

After steaming the printed nylon carpet for 15 minutes at 217° F., significant embossing due to pile shrinkage was observed. Thereafter, the embossed carpet was rinsed thoroughly with water, dried, and rubbed. The rinsing removed residual chemicals.

Both of the resulting carpet samples printed with and without protective agent exhibited about 29% embossment in perfect register with the printed area. The shrunk tufts of the control carpet without protective agent were well defined and strong but undesirably harsh to the touch. By comparison, the shrunk tufts of the embossed areas treated with Pomolube PE via the print paste were not only well defined and strong, but the usual harshness was greatly reduced so as to provide an acceptably soft product. The carpet color was not affected by the protective agent, and traffic soiling and soil retention were less than that of unembossed areas.

EXAMPLE IV

The nylon carpet construction cited in Example I was again treated by means of a screen printing technique using an embossing print paste system containing 48½% monochlorocetic acid as the chemical embossing agent and 1% Chemcoloft ARC as the protective agent. Chemcoloft ARC is a paste type cationic fatty acid condensate manufactured by Chemical Processing of Georgia. At the same time, a control sample was prepared similarly except that the protective agent was withheld from the print paste.

The embossing dye print paste containing the protective agent was formulated as follows:

| SAMPLE NO. 498SP-1 | |
|---|---|
| Material* | Grams |
| 1. Water | 30.7 |
| 2. Cibaphasol AS | 0.5 |
| 3. Antifoam #73 | 0.8 |
| 4. Polygum 260 (5%) | 19.0 |
| 5. Monochloracetic Acid | 49.0 |
| 6. Dye | 0.05 |
| 7. Chemcoloft ARC | 1.0 |

*4-Provided a Brookfield viscosity of 640 cps. at 78° F. (#3 spindle, 2½ rpm).
7-Paste type cationic fatty acid condensate, manufacture by Chemical Processing of Georgia. Dispersible, compatible, and stable in the highly acidic print paste.

The printed nylon carpet showed no evidence of embossing after being held at room conditions for several minutes. But when the carpet was subjected to steaming at about 216° F. for 15 minutes, a substantial differential in pile height occured due to fiber shrinkage between the printed and unprinted areas. Thereafter, the embossed carpet was thoroughly rinsed with water, dried and rubbed.

Both printed carpet samples with and without protective agent showed a reduction in pile height of 53% in register with the printed area. The shrunk pile retained its integrity and was strong in both cases. However, without protector, the nylon pile was undesirably harsh. By comparison, pile treated with Chemcoloft ARC remained acceptably soft. Carpet color was not affected by the protective agent. Traffic soiling tests conducted on additionally prepared samples, embossed with and without protective agent in the print paste, and without dye, demonstrated that the protective agent not only did not contribute to soiling or soil retention, but that embossed areas both with and without protective agent were far more resistant to soiling than unembossed areas (Sample Nos. 654SP-1, 655 SP-1 and 651SP-1).

EXAMPLE V

Additional embossed nylon carpet samples were prepared by means of the embossing procedure and utilizing the carpet construction described in Example I. Dye print pastes containing 48½% monochloroacetic acid and 1 to 2% of each of the following protective agents (Table I) were employed to obtain a desirable degree of softness of the chemically embossed areas.

TABLE I

| PROTECTIVE AGENTS | | |
|---|---|---|
| Name | Type | Source |
| Chromasist A-1 | 30% Active anionic | Nopco Chemical Division Diamond Shamrock Chem, Co. Morristown, N.J. |
| Cyanatex 3119 | Nonionic-glycol stearate ester | American Cyanamid Co., Bound Brook, New Jersey |
| Silicone Emulsion SM2040 | 35% Silicone Oil | General Electric Company |
| AC-Polyethylene 629 Emulsion | Polyethylene | Allied Chemical Corp. Morristown, N.J. |
| Ceranine HCA | Cationic fatty acid condensate | Sandoz, Inc. Hanover, New Jersey |

A standard sample were prepared similarly except that the agent was omitted from the embossing print paste receipt (#526SP-1).

Print paste recipes, print paste properties and the results of embossed carpet evaluation tests are shown in Table II including depth of embossment and embossed pile character.

All of these protective agents were found to relieve the harshness of the unprotected embossed pile providing an acceptably soft pile. In no case was color impaired and in every case resistance to soiling of the embossed pile was superior to that of the unembossed carpet pile.

It is thus seen from these results as well as the results obtained in Examples I through IV that a variety of protective agents are readily applicable to the novel process of this invention.

TABLE II

| Dye Print Paste No. | 641SP | 649SP | 640SP | 491SP | 495SP | 526SP |
|---|---|---|---|---|---|---|
| (DYE, PRINT, PASTE, RECIPE) | | | | | | |
| Water | 29.2 | 28.2 | 29.2 | 30.7 | 30.2 | 30.7 |
| Cibaphasol AS | 0.5 | 0.5 | 0.5 | 0.5 | 0.5 | 0.5 |
| Antifoam 73 | 0.8 | 0.8 | 0.8 | 0.8 | 0.8 | 0.8 |
| Polygum 260 (5%) | 20.5 | 20.0 | 20.5 | 19.0 | 19.0 | 20.0 |
| Monochloroacetic Acid | 49.0 | 48.5 | 49.0 | 49.0 | 48.5 | 49.0 |
| Dye | 0.05 | 0.05 | 0.05 | 0.05 | 0.05 | 0.05 |
| Chromasist A-1 | 1.0 | — | — | — | — | — |
| *Cyanatex 3119 | — | 2.0 | — | — | — | — |
| *Silicone Emulsion SM2040 | — | — | 1.0 | — | — | — |
| *AC-Polyethylene 629 EMUL. | — | — | — | 1.0 | — | — |
| *Ceranine HCA | — | — | — | — | 1.0 | — |
| PRINT PASTE PROPERTIES | | | | | | |
| **Viscosity (cps) 78° F. | 760 | 1280 | 720 | 640 | 8082 | 800 |
| Compatibility | OK | OK | OK | OK | OK | OK |

TABLE II-continued

| Dye Print Paste No. | 641SP | 649SP | 640SP | 491SP | 495SP | 526SP |
|---|---|---|---|---|---|---|
| | EMBOSSED CARPET | | | | | |
| Depth Embossed | 53 | 50 | 50 | 50 | 50 | 50 |
| Pile Character | Soft | Soft | Soft | Soft | Soft | Harsh |
| Color Change | None | None | None | None | None | None |
| Soiling Resistance | (SUPERIOR TO UNEMBOSSED PILE) | | | | | |

*Chromasist A-1 - Anionic - Nopco Chem.
Cyanatex 3119 - Nonionic, Glycol stearate ester - Amer. Cyanamid
SM2040 - Silicone Oil - General Elextric
AC-PE 629 - Polyethylene - Allied Chem.
Ceranine HCA - Cationic, fatty acid condenstate - Sandoz
**Brookfield #3 spindle, 2½ rpm.

EXAMPLE VI

Another typical product of the process of this invention was obtained by treating nylon carpet as in Example I by means of a screen printing technique, but using an embossing dye print paste containing 25% benzotriazole and 30% acetic acid as the chemical embossing composition, and 1% Pomosoft EAM (see description in Example I) as the protective agent. A control sample (#371SP-1) was prepared in a similar manner, except that no protective agent was added to the embossing print paste.

The print paste recipe containing the chemical embossing agent and protective agent was formulated as follows:

| SAMPLE NO. 706SP-1 | |
|---|---|
| Material* | Grams |
| 1. Water | 21.2 |
| 2. Cibaphasol AS | 1.0 |
| 3. Antifoam #73 | 0.8 |
| 4. Kelzan (1½%) + 0.2% Dowicide A | 21.0 |
| 5. Acetic Acid, Glacial | 30.0 |
| 6. Benzotriazole | 25.0 |
| 7. Dye | 0.05 |
| 8. Pomosoft EAM | 1.0 |

*4-Xanthan gum thickener plus preservative in water to provide a Brookfield viscosity of 1200 cps. at 78° F. (#3 spindle, 2½ rpm).
5-It is important that the Benzotriazole be added following the addition of acetic acid so that it will be soluble in the system.
8-Cationic compound supplied by Piedmont Chemical Industries, Easily compatible, and stable in the strong acidic print paste.

When the carpet was subject to steaming for 15 minutes at 217° F., deep embossment was observed due to fiber shrinkage at the treated areas.

After thoroughly washing and drying the carpet samples prepared with and without protector, a reduction in pile height of 47% was noted in the printed areas of both samples. Once again, the harshness of the deeply embossed area was reduced to an acceptable level due to the presence of the protective agent. Resistance to soiling and color remained satisfactory.

EXAMPLE VII

Nylon carpet was again treated as in Example I by means of a screen printing technique. In this case, 1% Pomosoft EAM (cationic) was used as the protective agent, while a combination of 25% zinc chloride and 25% acetic acid was employed as the chemical embossing agent. A control sample (723SP-1) was prepared in a similar manner except that no protective agent was added to the embossing print paste.

The print paste recipe contained the following ingredients:

| SAMPLE NO. 724SP-1 | |
|---|---|
| Materials* | Grams |
| 1. Water | 31.7 |
| 2. Cibaphasol AS | 0.5 |
| 3. Antifoam 73 | 0.8 |
| 4. Kelzan 1½% + 0.2% Dowicide A | 16.0 |
| 5. Zinc Chloride | 25.0 |
| 6. Acetic Acid | 25.0 |
| 7. Dye | 0.05 |
| 8. Pomosoft EAM | 1.0 |

*The Brookfield viscosity of this recipe at 78° F. was 1040 cps. at time of use (#3 spindle, 2½ rpm).

Upon steaming the above printed carpets for 15 minutes at 217° F., deep embossing developed due to nylon fiber shrinkage. Thereafter, the carpet was thoroughly rinsed with water and dried.

The embossed depth of both the protected and unprotected embossed areas was 41%. After rubbing the embossed areas to loosen the shrunken fibers, the area containing the agent was soft to touch, while the control area without softener was somewhat harsh. The protective agent did not affect the carpet color.

EXAMPLE VIII

Nylon carpet was treated as in Example I by means of a screen printing technique using a dye print paste containing 30% dimethyl thiourea and 27.5% formic acid as the embossing agent, and 1% of General Electric Silicone Emulsion SM2040 as the protective agent. A control sample (733SP-1) was prepared in a similar manner except that no protective agent was added to the embossing print paste.

The embossing print paste recipe containing the protective agent was as follows:

| SAMPLE NO. 734SP-1 | |
|---|---|
| Materials* | Grams |
| 1. Water | 19.1 |
| 2. Cibaphasol AS | 0.5 |
| 3. Antifoam #73 | 0.8 |
| 4. Kelzan 1½% + 0.2% Dowicide A | 18.0 |
| 5. Formic Acid (90%) | 30.6 |
| 6. Dimethylthiourea | 30.0 |
| 7. Dye | 0.05 |
| 8. Silicone Emulsion SM2040 | 1.0 |

*4-Provided a Brookfield viscosity of 600 cps. at 78° F. (#3 spindle, 2½ rpm).
5-To facilitate solubility, add the formic acid before adding the dimethylthiourea
9-35% Silicone emulsion manufactured by General Electric Company.

Upon steaming the treated carpet samples for 15 minutes at 217° F., deep embossing was observed. Thereafter, he carpet was thoroughly rinsed with water and dried.

Both of the resulting embossed carpets, with and without the protective agent exhibited deep embossing amounting to a 50% reduction in the carpet pile height in the treating areas. However, the embossed carpet without protective agent showed harshness, while the embossed carpet with Silicone SM2040 was acceptably soft to the touch. The agent did not affect the color of the embossed areas.

In the production of the pile fabrics of this invention, the pile yarn employed is prepared from fiber-forming synthetic linear polyamides. Examples of these fiber-forming synthetic linear polyamides are those obtainable from polymerizable monoaminomonocarboxylic acids and their amide-forming derivatives including caprolactam and those obtainable from the reaction of suitable diamines with suitable dibasic carboxylic acids or their amide forming derivatives. Such synthetic linear polyamides are referred to as nylon.

Nylon or polyamide polymers, filaments and fibers are well known to those skilled in the art and extensive discussion is, therefore, unnecessary. Thus, the term "polyamide" or "nylon" is known to include any long chain synthetic polymeric amide which has recurring amide groups as an integral part of the main polymer chain and which is capable of being formed into a filament in which the structural elements are oriented in the direction of the axis of that chain.

Polyamide resins coming within this definition and comtemplated in the practise of the present invention are formed generally by reaction of dicarboxylic acid with a diamine or by the self-condensation of an aminocarboxylic acid. Illustrative of these polyamide resins are nylon—6,6, prepared by the condensation of hexamethylenediamine and adipic acid; nylon—6,10, prepared from hexamethylenediamine and sebacic acid, both of the foregoing having as prepared, molecular weights exceeding 10,000:nylon-6 produced by thermal polymerization of epsilon-aminocaproic acid or caprolactam; nylon-11, the self-condensation produce of 11-aminoundecanoic acid; as well as a variety of polymers prepared from polymerized, unsaturated fatty acids and polyamino compounds.

The practise of the present invention has, however, particular application to solid melt-extrudable and orientable fiber-forming polyamides and more particularly to fibers and filaments prepared there from which have a denier and tenacity appropriate, and well known to those skilled in the art, for use in carpets, rugs, tapestry and the like. Illustrative of these polyamides are those having a filament denier of 2–30 or higher or nylon yarns in the denier range of 15–15,000 or higher. The tenacities of nylon yarn for use herein are within the range of 3–10 grams per denier. The elongation of commercial fibers can range between 16 and 65%. The undrawn filament is capable of being stretches as such as 5 times. It is understood additionally that encompassed within the polyamides that can be employed in the practise of this invention are high molecular weight synthetic linear polyamides, in addition to those described hereinabove, that have been modified, for example, to enhance their usefulness for particular applications.

An extended discussion of polyamides of sufficiently high molecular weight to be capable of being melt spun into filaments and coming within the contemplation of this invention appears in D. E. Floyd, *Polyamide Resins*, Reinhold Plastics Applications Series, Reinhold Publishing Corporation, New York, New York (2nd Printing 1961), and H. R. Mauersberger, *Matthews' Textile Chemical Properties*, John Wiley & Sons, Inc., New York, New York, pp. 933–971, 1034., (6th ed. 1954), Mary E. Carter, *Essential Fiber Chemistry*, Marcel Dekker, Inc., New York 1971, pp. 91–109, and H. F. Mark, S. M. Atlas, E. Cernia (Edited by), *Man-Made Fibers, Science and Technology* Volume 2, Interscience Publishers 1968, pp. 181–295, and tech.—Talk from Monsanto Textiles Division, Bulletin TT-35 August 1969.

Methods of shrinking carpet fibers have been described in copending applications Ser. No. 386,048 filed Aug. 6, 1973, Ser. No. 386,037 filed Aug. 6, 1973 and Ser. No. 386,047 filed Aug. 6, 1973.

Summarizing, it is thus seen that this invention provides a novel and effective method for embossing nylon pile fabrics.

Variations may be made in procedures, proportions, and materials without departing from the scope of the invention as defined in the following claims.

What is claimed is:

1. In a process for producing an embossed effect on nylon pile fabric having a surface of nylon fibers which process comprises, applying to defined areas of the piled surface of said fabric a chemical embossing agent for said fibers, said agent having the capacity to reduce said fibers in the length to an extent of at least 10 percent of their length, the improvement which comprises incorporation into a chemical composition with said embossing agent a protective agent for said fibers compatible with the chemical ingredients of said embossing composition and allowing said embossing composition to remain in contact with said fibers for the same total time and temperature employed to reduce the height of said pile and, thereafter, selectively removing said embossing agent from said fabric, said protective agent suppressing the development of hardness, harshness and stiffness in the shrunk fibers.

2. The process in accordance with claim 1 wherein the protective agent is selected from the group consisting of cationic agents, quaternary ammonium agents, amphoteric agents, nonionic agents, anionic agents, and blends of said agents.

3. The process of claim 2 wherein said protective agent is in concentrations of ¼ percent to 5 percent by weight, of total embossing composition.

4. The process of claim 3 wherein said embossing agent is incorporated in a transparent vehicle therefor.

5. The process of claim 3 wherein said embossed effect is made in register with a printed color design on said fabric and said vehicle is a dye printing paste carrying said embossing agent.

6. The process of claim 3 wherein said embossing action occurs in approximately 15 minutes at a temperature about 50° C.

7. The process in accordance with claim 6 wherein the embossing action occurs in a steam environment.

8. A nylon pile carpet material consisting of pile fastened to a base, said pile having selected areas thereof, embossed by chemical shrinkage so that the selected areas display a pile of significantly shorter length than the untreated areas, said selected reduced height fibers being of the same color and texture as the remaining areas, but not more than about 80–90% of the height said selected reduced height areas having the same softness characteristics as the unreduced height areas.

9. A nylon fabric in accordance with claim 8, in which the embossed areas are of a different color from the untreated areas.

* * * * *